United States Patent [19]

Pittet et al.

[11] 4,014,351

[45] * Mar. 29, 1977

[54] NOVEL TOBACCO FLAVORING AND AROMA COMPOSITIONS AND TOBACCOS CONTAINING ALPHA-SUBSTITUTED ACETALDEHYDE

[75] Inventors: Alan Owen Pittet, Atlantic Highlands; Erich Manfred Klaiber, Neptune; Manfred Hugo Vock, Locust, all of N.J.; Edward J. Shuster, Brooklyn, N.Y.; Joaquin Vinals, Red Bank, N.J.

[73] Assignee: International Flavors & Fragrances Inc., New York, N.Y.

[ * ] Notice: The portion of the term of this patent subsequent to Feb. 24, 1993, has been disclaimed.

[22] Filed: July 24, 1975

[21] Appl. No.: 598,652

Related U.S. Application Data

[63] Continuation-in-part of Ser. No. 507,412, Sept. 19, 1974, Pat. No. 3,940,499.

[52] U.S. Cl. ..... 131/17 R; 131/144

[51] Int. Cl.[2] ..... A24B 3/12

[58] Field of Search ..... 131/2, 17 R, 144; 426/534, 535, 536, 538; 252/522; 260/598

[56] References Cited

UNITED STATES PATENTS

| | | | |
|---|---|---|---|
| 2,957,933 | 10/1960 | Pommer et al. | 260/598 X |
| 3,940,499 | 2/1976 | Pittet et al. | 131/17 R X |

*Primary Examiner*—Robert W. Michell
*Assistant Examiner*—V. Millin
*Attorney, Agent, or Firm*—Arthur L. Liberman; Harold Haidt; Franklin D. Wolffe

[57] ABSTRACT

Processes and compositions are described for the use in tobacco flavor and aroma and as tobacco flavor and aroma imparting, altering, modifying, or enhancing materials of 2,2,6-trimethyl-1-cyclohexen-1-ylacetaldehyde (hereinafter referred to as "beta-cyclohomocitral") produced by a process which either (A) comprises the steps of:

i. Oxidizing beta-ionone having the formula:

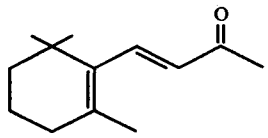

with a peralkanoic acid having the formula:

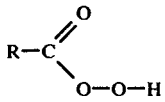

(wherein R is H, methyl or ethyl) in the presence of buffer and in the absence of dimethyl formamide, to form 2,2,6-trimethyl-1-cyclohexen-1-ylvinylacetate (hereinafter referred to as "beta-ionone enol ester") having the formula:

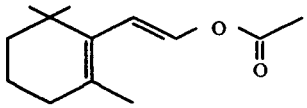

; and ii. Hydrolyzing said beta-ionone enol ester using a basic hydrolysis agent to form beta-cyclohomocitral having the structure:

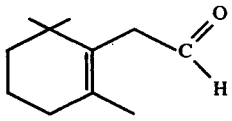

3 Claims, No Drawings

NOVEL TOBACCO FLAVORING AND AROMA COMPOSITIONS AND TOBACCOS CONTAINING ALPHA-SUBSTITUTED ACETALDEHYDE

This application is a continuation-in-part of Ser. No. 507,412, filed Sept. 19, 1974, now U.S. Pat. No. 3,940,499.

BACKGROUND OF THE INVENTION

The present invention relates to 2,2,6-trimethyl-1-cyclohexen-1-ylacetaldehyde (or "beta-cyclohomocitral") produced by, interalia, a novel process described and claimed in copending Application for U.S. Pat. No. 507,414 filed on Sept. 19, 1974 now U.S. Pat. No. 3,956,393 and copending application for U.S. Pat. No. 3,980,708, and novel compositions using such beta-cyclohomocitral to impart, alter, modify, or enhance the flavor and/or aroma of tobacco and tobacco flavoring compositions.

There has been considerable work performed relating to substances which can be used to impart (or alter, modify, or enhance) flavors and fragrances to (or in) tobacco. These substances are used to diminish the use of natural materials, some of which may be in short supply and to provide more uniform properties in the finished product. Sweet, rich-tobacco, floral, fruity, green, woody, "damascenone-like" and earthy notes are desirable in tobacco flavoring compositions.

Arctander, "Perfume and Flavor Chemicals", 1969 discloses the use in perfume compositions and flavors of "cyclocitral", "dehydro-beta-cyclocitral", "isocyclocitral", "alphacyclocitrylidene acetaldehyde" and "beta cyclotrylidene acetaldehyde", thus:

i. "760: CYCLOCITRAL

Alpha-cyclocitral = (2,2,6-trimethyl-5-cyclohexen-1-carboxaldehyde).

Beta-cyclocitral = (2,2,6-trimethyl-6-cyclohexen-1-carboxaldehyde). Both isomers are known and have been produced separately.

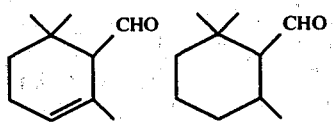

Very rarely offered commercially. These particular cyclocitrals have little or no interest to the creative perfumer, but they have served as part of many pieces of proof that isomers (alpha-beta) do often have different odors."

ii. "761; iso-CYCLOCITRAL A mixture of two chemicals: 3,5,6-trimethyl-3-cyclohexen-1-carboxaldehyde (metal-cyclocitral).

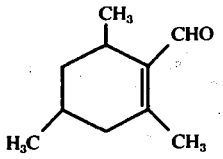

2,4,6-trimethyl-4-cyclohexen-1-carboxaldehyde (symmetric-iso-cyclocitral).

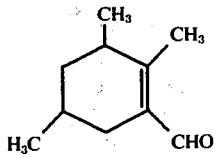

Powerful, and diffusive, foliage-green, "dark" weedy and dry odor, sometimes described as "Flower-shop odor". The earthy and wet-green notes are quite natural in high dilution and resemble the odor of stems from plants and flowers fresh from the soil.

Finds use in perfume compositions where it blends excellently with Oakmoss products (compensates for sweetness and lifts the topnote), with Ionones (freshness), Geranium and Galbanum (enhances the green and "vegetable" notes), etc. ...."

iii. "762: apha CYCLOCITRYLIDENE ACETALDEHYDE

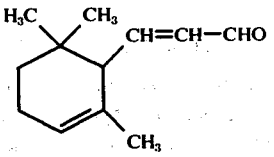

Mild, floral-woody, somewhat oily-herbaceous odor, remotely reminiscent of Rose with similarity to the odor of hydrogentated Ionones.

Suggested for use in perfume compositions. It brings a certain amount of floral lift to Rose compositions, and performs fairly well even in soap. However, the cost of the rarely offered and never readily available lots and rather discouraging to the perfumer, and it is most conceivable that this material can be left out of the perfumer's library without any great loss. ..."

iv. "763: beta-CYCLOCITRYLIDENE ACETALDEHYDE 2,6,6-trimethyl-1-cyclohexenyl-beta-acrolein.

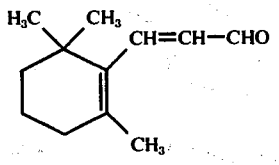

Sweet-woody, rather heavy odor, resembling that of beta-Ionone. More fruity than really floral, but not as tenacious as the Ionone.

Suggested for use in perfume compositions, but since it does not offer any new or unusual odor characteristics, and it cannot be produced in economical competition to beta-Ionone, there is little or no chance that it will ever become a standard shelf ingredient for the perfumer. ..."

V. "869" DEHYDRO-beta-CYCLOCITRAL (Safranal) 2,6,6-trimethyl-4,4-cyclohexadiene-1-carboxaldehyde

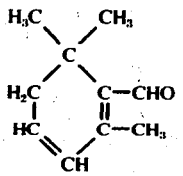

Very powerful, sweet, green-floral and somewhat tobacco-herbaceous odor of good tenacity In extreme dilution reminiscent of the odor of Safran (Saffron).

Interesting material for fresh topnotes, as a modifier for aldehydic-citrusy notes, as a green-floral topnote in flower fragrances, etc. It blends excellently with the aliphatic Aldehydes, with Oakmoss products and herbaceous oils. ..."

Safranal and beta-cyclocitral are disclosed as volatile constituents of Greek Tobacco by Kimland et al., Phytochemistry 11 (309) 1972. Beta-cyclocitral is disclosed as a component of Burley Tobacco flavor by Demole aand Berthet, Helv. Chim. Acta. 55 Fasc-6, 1866 (1972).

THE INVENTION

It has now been discovered that tobacos having fruity tobacco tastes and novel tobacco flavoring compositions having sweet, rich-tobacco, floral, fruity, green, woody, "damascenonelike" ("Damascenone" is a compound having the structure:

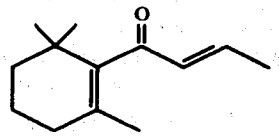

Its organoleptic properties are set forth in Swiss Patent 520,479 issued on May 12, 1972 and United Kingdom Patent Number 1,240,309 published on July 21, 1971) and earthy notes may be provided by the utilization of beta-cyclohomocitral having the formula:

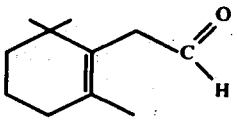

in tobaccos as well as tobacco substitutes.

The beta-cyclohomocitral so useful, may be produced, preferably, by processes which comprises either (A) a reaction carried out in two steps, the first of which is an oxidation reaction of beta-ionone with either performic acid, peracetic acid or perpropionic acid to form beta-ionone enol ester and, secondly, hydrolyzing the beta-ionone enol ester in the presence of base (either aqueous or alcoholic) to form the desired beta-cyclohomocitral or (B) forming beta-cyclohomocitral by oxidizing beta-ionone with hydrogen peroxide in the presence of inorganic base.

More specifically, the process (A) comprises the steps of:

i. Reacting beta-ionone having the formula:

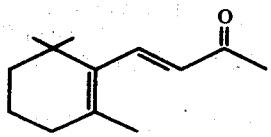

in the absence of dimethyl formamide with a peralkanoic acid having the formula:

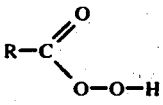

(wherein R is hydrogen, methyl or ethyl) to form beta-ionone enol ester having the formula:

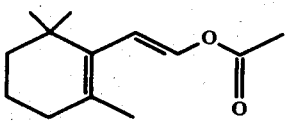

and not the expected beta-ionone epoxide having one of the formulae:

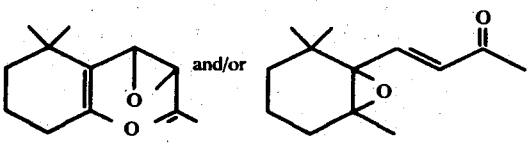

ii. hydrolyzing the beta-ionone enol ester in the presence of base (aqueous or alcoholic) to form beta-cyclohomocitral.

Insofar as the oxidation reaction is concerned:

A. where peralkanoic acids are used as the oxidizing agents, the reaction is preferably carried out in the presence of a buffer such as an alkali metal salt of a lower alkanoic acid or an alkali metal carbonate with a lower alkanoic acid such as propionic acid, acetic acid or formic acid with the following provisos:

i. The reaction is preferably carried out at temperatures of from 15° C up to about 75° C. Lower temperatures result in slower and less complete reaction and higher temperatures than 75° C result in lower yields of the desired product and significantly higher percentages of by-products. The most preferred temperature of reaction is 25° C.

ii. A slight molar excess (from 10 up to 15 percent) of peracetic acid gives a slightly higher yield of product. A large excess about 200 percent), however, results in the formation of dihydroactinodiolide having the structure:

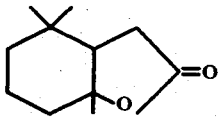

in about 30–35 percent yield when no buffer (e.g., potassium acetate) is present in the reaction mass;

iii. Where potassium carbonate is substituted for potassium acetate as a buffer, the yield of product obtained is substantially the same;

iv. on the other hand, a slightly lower yield of product is obtained by substituting sodium acetate for potassium acetate as the buffer;

v. Substitution of formic acid for acetic acid in the reaction mass gives rise to a lower yield of product.

vi. Any solvent inert to the action of peralkanoic acids may be used in this first oxidation reaction using alkanoic acids. For instance, the use of cyclohexane or chloroform as a solvent does not have an appreciable effect on the yield of product;

vii. Omission of the buffer (i.e., thus performing the reaction under strongly acidic conditions) results in an incomplete reaction, lower yield and greater quantity of by-products(s);

viii. The use of dimethyl formamide as solvent results in the exclusive formation of beta-ionone epoxide having the structure:

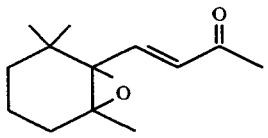

in about 70–75% yield and, accordingly, the presence of dimethyl formamide must be avoided;

ix. The use of monoperphthalic acid (formed in situ from phthalic anhydride and hydrogen peroxide) yields beta-ionone epoxide in 60–70 percent yield. The use of perbenzoic acid in place of a peralkanoic acid has also been used to make beta-ionone epoxide R. Yves, et al., Helv. Chim. Acta, 29, 880 (1946).

It may be concluded that a peralkanoic acid such as peracetic acid in slight excess in the presence of a buffer system, preferably composed of acetic/potassium acetate is the preferred way to oxidize beta-ionone at 25° C to the corresponding enol acetate.

The beta-ionone enol ester preferably is hydrolyzed by 10 percent alkali metal hydroxide (e.g., potassium hydroxide, lithium hydroxide or sodium hydroxide) in admixture with 50 percent aqueous methanol, although other mild hydrolysis conditions (such as aqueous potassium carbonate, sodium carbonate or lithium carbonate solution) may also be used. As a result of the hydrolysis, beta-cyclohomocitral is formed.

The resultant reaction product, beta-cyclohomocitral may then be refined according to standard techniques, e.g., preparative gas chromatography, extraction, distillation and the like as further exemplified herein.

B. Where hydrogen peroxide (in the presence of inorganic base) is used as the oxidizing agent, the beta-cyclohomocitral is formed in one step from beta-ionone. The strength of hydrogen peroxide used is from about 10 percent up to about 50 percent. The inorganic base used may be an alkali metal hydroxide or alkali metal carbonate such as sodium carbonate, potassium carbonate, lithium carbonate, sodium hydroxide, potassium hydroxide or lithium hydroxide; preferably sodium hydroxide. The mole of hydrogen peroxide:-beta-ionone is preferably from about 1.1:1 up to about 3:1.

The aforementioned processes are specific to beta-ionone. As further exemplified infra, when the reaction conditions of this process are applied to alpha-ionone, as opposed to beta-ionone, epoxide formation occurs and neither a substantial amount of enol acetate nor isomers of beta-cyclohomocitral are formed.

The 2,2,6-trimethyl-1-cyclohexen-1-ylacetaldehyde (or beta-cyclohomocitral) of our invention is capable of supplying and/or potentiating certain flavor and aroma notes usually lacking in many tobacco flavors heretofore provided.

As used herein in regard to tobacco flavors, the terms "alter" and "modify" in their various forms mean "supplying or imparting flavor character or note to otherwise bland tobacco, tobacco substitutes, or tobacco flavor formulations or augmenting the existing flavor characteristic where a natural flavor is deficient in some regard or supplementing the existing flavor impression to modify its quality, character or taste".

As used herein, the term "enhance" is intended to mean the intensification (without change in kind of quality of aroma or taste) of one or more taste and/or aroma nuances present in the organoleptic impression of tobacco or a tobacco substitute or a tobacco flavor.

Our invention thus provides a organoleptically improved smoking tobacco product and additives therefor, as well as methods of making the same which overcome specific problems heretofore encounted in which specific desired woody "damascenone-like" flavor characteristics of natural tobacco are created or enhanced and may be readily controlled and maintained at the desired uniform level regardless of variations in the tobacco components of the blend.

This invention further provides improved tobacco additives and methods whereby various desirable damascenone-like, woody flavoring characteristics with sweet, floral, fruity, earthy and green notes may be imparted to smoking tobacco products and may be readily varied and controlled to produce the desired uniform flavoring characteristics.

In carrying out this aspect of our invention, we add to smoking tobacco materials or a suitable substitute therefor (e.g., dried lettuce leaves) an aroma and flavor additive containing as an active ingredient beta-cyclohomocitral.

In addition to the beta-cyclohomocitral of our invention other flavoring and aroma additives may be added to the smoking tobacco materials or substitute therefor either separately or in mixture with the beta-cyclohomocitral as follows:

I. Synthetic Materials:

Beta-ethyl-cinnamaldehyde;
Eugenol;
Dipentene;
Damascenone;
Maltol;
Ethyl maltol;
Delta undecalactone;
Delta decalactone;
Benzaldehyde;
Amyl acetate;
Ethyl butyrate;
Ethyl valerate;
Ethyl acetate;
2-Hexenol-1,2-methyl-5-isopropyl-1,3-nonadiene-8-one;
2,6-Dimethyl-2,6-undecadiene-10-one;
2-Methyl-5-isopropyl acetophenone;
2-Hydroxy-2,5,5,8a-tetramethyl-1-(2-hydroxyethyl)-decahydronaphthalene;

Dodecahydro-3a-6,6,9a-tetramethyl naphtho-(2,1-b)-furan;

4-Hydroxy hexanoic acid, gamma lactone;

Polyisoprenoid hydrocarbons defined in Example V of U.S. Patent 3,589,372 issued on June 29, 1971.

II. Natural Oils

Celery seed oil;
Coffee extract;
Bergamot Oil;
Cocoa extract;
Nutmeg oil;
Origanum oil An aroma and flavoring concentrate containing betacyclohomocitral and, if desired, one or more of the above indicated additional flavoring additives may be added to the smoking tobacco material, to the filter or to the leaf or paper wrapper. The smoking tobacco material may be shredded, cured, cased and blended tobacco material or reconstituted tobacco material or tobacco substitutes (e.g., lettuce leaves) or mixtures thereof. The proportions of flavoring additives may be varied in accordance with taste but insofar as enhancement or the imparting of natural and/or sweet notes, we have found that satisfactory results are obtained if the proportion by weight of the sum total of beta-cyclohomocitral to smoking tobacco material is between 250 ppm and 1,500 ppm (0.025–0.15%) of the active ingredients to the smoking tobacco material. We have found that satisfactory results are obtained if the proportion by weight of the sum total of beta-cyclohomocitral used to flavoring material is between 2,500 and 10,000 ppm (0.25–1.5%).

Any convenient method for incorporating the beta-cyclohomocitral in the tobacco product may be employed. Thus, the beta-cyclohomocitral taken alone or along with other flavoring additives may be dissolved in a suitable solvent such as ethanol, pentane, diethyl ether and/or other volatile organic solvents and the resulting solution may either be spread on the cured, cased and blended tobacco material or the tobacco material may be dipped into such solution. Under certain circumstances, a solution of the beta-cyclohomocitral taken alone or taken further together with other flavoring additives as set forth above, may be applied by means of a suitable applicator such as a brush or roller on the paper or leaf wrapper for the smoking product, or it may be applied to the filter by either spraying, or dipping, or coating.

Furthermore, it will be apparent that only a portion of the tobacco or substitute therefor need be treated and the thus treated tobacco may be blended with othe tobaccos before the ultimate tobacco product is formed. In such cases, the tobacco treated may have the beta-cyclohomocitral in excess of the amounts or concentrations above indicated so that when blended with other tobaccos, the final product will have the percentage within the indicated range.

In accordance with one specific example of our invention, an aged, cured and shredded domestic burley tobacco is spread with a 20% ethyl alcohol solution of beta-cyclohomocitral in an amount to provide a tobacco composition containing 800 ppm by weight of beta-cyclohomocitral on a dry basis. Thereafter, the alcohol is removed by evaporation and the tobacco is manufactured into cigarettes by the usual techniques. The cigarette when treated as indicated has a desired and pleasing aroma which is detectable in the main and side streams when the cigarette is smoked. This aroma is described as being sweeter, rich, less harsh, more tobacco-like and having woody, damascenone-like notes.

While our invention is particularly useful in the manufacture of smoking tobacco, such as cigarette tobacco, cigar tobacco and pipe tobacco, other tobacco products formed from sheeted tobacco dust or fines may also be used. Likewise, the beta-cyclohomocitral of our invention can be incorporated with materials such as filter tip materials, seam paste, packaging materials and the like which are used along with tobacco to form a product adapted for smoking. Furthermore, the beta-cyclohomocitral can be added to certain tobacco substitutes of natural or synthetic origin (e.g., dried lettuce leaves) and, accordingly by the term "tobacco" as used throughout this specification is meant any composition intended for human consumption by smoking or otherwise, whether composed of tobacco plant parts or substitute materials or both.

Examples I–VIII, X, XI, XIII, XV and XVI following, serve to illustrate processes for producing beta-cyclohomocitral useful in our invention. Example IX, following, serves to illustrate the unworkability of this process where dimethyl formamide is used in the oxidation reaction of beta-ionone with peracetic acid. Example III, serves to illustrate the unworkability of the reaction where no buffer, e.g., sodium acetate, is used. Examples XIV and XVII illustrate the utility of beta-cyclohomocitral in the practice of our invention. Example XII illustrates the unworkability of the above process in forming alpha-ionone enol ester when operated on alpha-ionone rather than beta-ionone. It will be understood that these Examples are illustrative and the invention is to be considered restricted thereto only as indicated in the appended claims. All parts and percentages given herein are by weight unless otherwise specified.

EXAMPLE I

A. PRODUCTION OF BETA-IONONE ENOL ESTER FROM BETA-IONONE

Into a two liter reaction flask equipped with stirrer, thermometer, reflux condenser, addition funnel and cooling bath, the following materials are added:

i. Solution of 96 grams beta-ionone in 300 cc chloroform;

ii. 30 grams sodium acetate

95 Grams of 40 percent peracetic acid is then added, with cooling, slowly at 10° C during a period of one hour. The reaction mass is stirred at 10° C for an additional hour and the solution is then allowed to slowly warm up to room temperature. The reaction mass is then poured into one liter of water and the resultant organic and aqueous phases are separated. The aqueous phase is then extracted with 100 cc of chloroform and the resultant organic phases are then bulked. The solvent is evaporated from the organic phase to yield 99.5 grams of an oil which is then chromatographed on 1,000 grams of alumina deactivated with 5% w/w water and eluted as follows:

| Fraction | Volume of Solvent | Quantity of Solute Eluted |
|---|---|---|
| 1 | 750 cc hexane | 8.0 grams |
| 2 | 500 cc hexane | 31.7 grams |
| 3 | 300 cc hexane | 13.5 grams |
| 4 | 250 cc hexane | 7.0 grams |
| 5 | 250 cc hexane | 1.9 grams |
| 6 | 250 cc hexane | 1.6 grams |
| 7 | 600 cc 25% diethyl ether-75% hexane | 15.6 grams |
| 8 | 600 cc diethyl ether | 15.3 grams |

Fractions 1–4 are composed mainly of beta-ionone enol ester.

The spectral data for a purified sample of this material obtained by preparative gas chromatography confirm the structure:

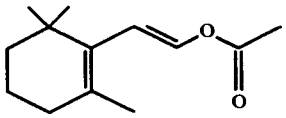

The mass spectrum of this compound has the following fragmentation pattern, in decreasing order of ion abundance:

m/e 166 (100), 151 (81), 43 (30), 208 (30) (molecular ion) and 95(18). The infrared spectrum shows the following characteristic absorption bands ($cm^{-1}$):

| | |
|---|---|
| 3090 | H, C=C, H (C—H) |
| 1752 | C=O (vinyl ester) |
| 1650 | C=C (conjugated with oxygen) |
| 1360, 1380 | $CH_3$, C, $CH_3$ |
| 1365 | $-CH_3$ |
| 1215 | C—O (of the ester) |
| 1080 | |
| 930 | H, C=C, H |

The NMR spectrum exhibits in $CDCl_3$ solution the following proton absorptions (chemical shifts in ppm):

| Ppm | Multiplicity | Assignment | No. of Protons |
|---|---|---|---|
| 1.00 | (s) | $CH_3$, $CH_3$, C | 6H |
| 1.70–1.40<br>1.76 | (m)<br>(s) | $-CH_2-$<br>$=C-CH_3$ | 7H |
| 2.00 | (t) | $=C-CH_2-$ | 2H |
| 2.16 | (s) | $CH_3-C(=O)-O-$ | 3H |
| 5.86 and 7.20 | (m) | Olefinic protons | 2H |

B. HYDROLYSIS TO FORM BETA-CYCLOHOMOCITRAL FROM BETA-IONENE ENOL ESTER

Beta-ionone enol ester (60.2 grams from Fractions 1–4 produced in Part A) is added to 280 cc of 10 percent potassium hydroxide solution, (50:50 water:methanol mixture) at room temperature and stirred for a period of 30 minutes. Water 1,000 cc is added to the reaction which is then extracted with three 250 cc portions of diethyl ether. The combined ether extract is washed twice with two 100 cc portions of saturated sodium chloride solution, dried over anhydrous magnesium sulfate and evaporated to obtain 53 grams of an oil, beta-cyclohomocitral.

The crude beta-cyclohomocitral is distilled at 2 mm Hg pressure and the fraction boiling at 70°–80° C is collected (35.6 g).

Gas chromatographic analysis indicates that the product is about 85% pure. A pure sample of beta-cyclohomocitral is obtained by preparative chromatography (conditions: 10 feet × ¼ inches 10% carbowax 20M-packed stainless steel column at 220° C isothermal) and is characterized by the following analytical data as:

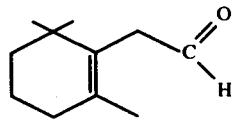

Mass spectral fragmentation, in decreasing order of ion abundance:

m/e (%) 107 (100); 29 (93); 151 (90); 41 (88); 81 (80); 95 (67); 123 (57); 55 (45); 39 (45); 27 (43); 166 (Mol ion) (35).

The infrared spectrum shows the following characteristic absorption bands ($cm^{-1}$):

| | |
|---|---|
| 2760 | O, C—H |
| 1770 | C=O (unconjugated) |
| 1380, 1360 | $CH_3$, $CH_3$, C |
| 1375 | $-CH_3$ |

The NMR spectrum of the compound is in agreement with the above structure:

| (PPM) | Multiplicity | Assignment | Number of Protons |
|---|---|---|---|
| 0.98 | (s) | $CH_3$, C, $CH_3$ | 6H |
| 1.58<br>1.80–1.42 | (s)<br>(m) | $=C-CH_3$<br>$-CH_2-$ | 9H |
| 2.00 | (t) | $=C-CH_2-C(=O)$ | 2H |
| 9.58 | (t) | HC=O | 1H |

EXAMPLES II-X

The following examples, carried out using the same procedure as Example I, illustrate the results which occur when parameters of the oxidation reaction of beta-ionone with peracetic acid are varied, e.g., as to buffer, solvent, temperature presence of organic base and ratio of organic alkanoic acid to peracetic acid. The percentages given are obtained by gas chromatographic analyses of the reaction mixture after 30 minutes and do not represent yields of isolated material.

| Example No. | % Enol Ester | % Starting Material | % By-Products | Reactants and Reaction Conditions |
|---|---|---|---|---|
| II | 47 | 24 | 29 | Acetic acid-(150 cc)<br>Sodium acetate-(20 g)<br>Beta-ionone-(30 g)<br>40% peracetic acid-(30 g)<br>Temperature: 25° C. |
| III | 12 | 52 | 36 | Acetic acid-(150 g)<br>Beta-ionone-(30 g)<br>40% peracetic acid-(30 g)<br>Temperature: 25° C. |
| IV | 40 | 29 | 31 | Cyclohexane-(150 cc)<br>Sodium acetate-(20 g)<br>Beta-ionone-(30 g)<br>40% peracetic acid (30 g)<br>Temperature: 25° C. |
| V | 52 | 26 | 22 | Acetic acid-(150 cc)<br>Potassium acetate-(35 g)<br>Beta-ionone-(30 g)<br>40% peracetic acid-(30 g)<br>Temperature: 25° C. |
| VI | 31 | 30 | 39 | Formic acid-(150 cc)<br>Potassium acetate-(50 g)<br>Beta-ionone-(30 g)<br>40% peracetic acid-(30 g)<br>Temperature: 25° C. |
| VII | 49 | 6 | 45 | Acetic acid-(150 cc)<br>Potassium acetate-(35 g)<br>Beta-ionone-(30 g)<br>40% Peracetic acid-(33 g)<br>Temperature: 25° C. |
| VIII | 36 | 21 | 43 | Acetic acid-(150 cc)<br>Potassium acetate-(35 g)<br>Beta-ionone-(30 g)<br>40% Peracetic acid-(33 g)<br>Temperature: 50° C. |
| IX | 0 | 9 | 91<br>Beta-ionone epoxide | Dimethyl formamide-(150 cc)<br>Beta-ionone-(30 g)<br>40% peracetic acid-(33 g)<br>Temperature: 4 days at a temperature of 18° C. |
| X | 55 | 17 | 28 | Acetic acid-(450 cc)<br>Potassium acetate-(105 g)<br>Beta-ionone-(96 g)<br>40% peracetic acid-(105 g)<br>Temperature: 25° C. |

EXAMPLE XI

PREPARATION OF BETA-CYCLOHOMOCITRAL BY $H_2O_2$ PEROXIDATION OF BETA-IONONE

To 20 grams of beta-ionone in 100 ml methanol is added 12 ml of 30% hydrogen peroxide. The solution is then cooled to 15° C and 18 ml 6 molar aqueous sodium hydroxide is added over a period of 30 minutes while maintaining the reaction mixture at 15° C. The reaction mixture is then allowed to warm up to 30° C and then maintained at 30° C with external cooling. The exotherm lasts approximately 60 minutes. Examination of the reaction product by gas chromatography indicates that some betaionone is still present. An additional 12 ml of 30% $H_2O_2$ and 18 ml 6 molar aqueous NaOH are added during a 30-minute period while maintaining the temperature at 25° C. Again an exotherm occurs lasting approximately 60 minutes during which time the temperature is maintained at 30° C. The reaction mass is then poured into excess water (500 ml) and the product is then extracted with three 150 ml portions of diethyl ether. The combined ether extracts are then washed with two 150 ml portions of saturated sodium chloride solution and dried over anhydrous $MgSO_4$. The solvent is then evaporated to yield 16.8 grams of a crude oil.

Examination of this material by gas chromatography indicates 22% beta-cyclohomocitral.

The desired product is obtained by preparative gas chromatography (conditions: 10 feet × ¼ inch 10% Carbowax 20 M packed stainless steel column at 220° C isothermal).

The structure is confirmed by IR, MS and NMR analyses as being:

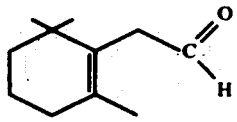

EXAMPLE XII

FORMATION OF ALPHA-IONONE EPOXIDE FROM ALPHA-IONONE

Into a 500 ml flask equipped with thermometer, stirrer, addition funnel and reflux condenser, the following materials are placed in the following order:

| Ingredients | Amount |
|---|---|
| Acetic Acid | 150 cc |
| Potassium Acetate | 35 grams |
| Alpha-Ionone | 30 grams |

33 Grams of 40% peracetic acid is then added dropwise into the reaction mass with stirring at 25° C over a 45-minute period. The reaction mass exotherms for approximately one hour and is then allowed to remain at room temperature for a period of 15 hours.

The reaction mass is then poured into 500 ml water and the product is extracted with three 150 cc portions of diethyl ether. The ether extracts are combined and washed with two 100 cc portions of saturated sodium chloride solution and dried over anhydrous magnesium sulfate. The residual oil obtained after stripping the solvent, is distilled at 93°–99° C at 0.5 mm Hg pressure yielding 28.3 g of a clean colorless liquid.

IR, MS and NMR analyses confirm the fact that the product is alpha-ionone epoxide having the structure:

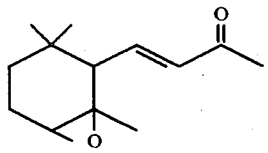

EXAMPLE XIII

PRODUCTION OF BETA-CYCLOHOMOCITRAL

Into a two liter reaction flask equipped with stirrer, thermometer, addition funnel and cooling bath, the following materials are placed in the following order:

| Ingredients | Amounts |
|---|---|
| Acetic Acid | 450 cc |
| Potassium Acetate | 105 grams |
| Beta-Ionone | 96 grams |

105 Grams of 40% peracetic acid is then added dropwise to the reaction mass with cooling while maintaining the reaction mass at 25° C+2° C over a two-hour period. The reaction mass is then stirred for an additional three-hour period (during the first hour a slight exotherm occurs) at 25° C.

The reaction mass is then poured into 1,000 ml water and the resultant product is extracted with three 300 cc volumes of diethyl ether. The ether extracts are combined and washed with two 150 cc portions of saturated sodium chloride solution. The resultant washed ether extract is then evaporated whereby 118 grams of residual oil is obtained.

400 cc of 10% potassium hydroxide solution (50:50 mixture, water:methanol) is prepared and the 118 grams of residual oil obtained above is added thereto. The resultant solution warms up slightly and is stirred for a period of 45 minutes.

The solution is then poured into 500 ml water and the product is extracted with three 250 cc portions of diethyl ether. The diethyl ether extract is then washed with two 200 cc portions of saturated sodium chloride solution, dried over anhydrous magnesium sulfate and evaporated to obtain 89 grams of a crude oil. This crude oil is distilled through a Vigreaux distillation column at 70°–75° C ad 2.0 mm Hg pressure to obtain 40.2 grams of a compound having the structure:

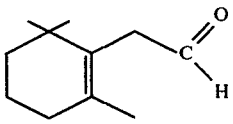

as confirmed by infrared (IR), nuclear magnetic resonance (NMR) and mass (MS) spectra.

EXAMPLE XIV

TOBACCO FORMULATION

A tobacco mixture is produced by admixing the following ingredients:

| Ingredients | Parts by Weight |
|---|---|
| Bright | 40.1 |
| Burley | 24.9 |
| Maryland | 1.1 |
| Turkish | 11.6 |
| Stem (flue-cured) | 14.2 |
| Glycerine | 2.8 |
| Water | 5.3 |

Cigarettes are prepared from this tobacco.

The following flavor formulation is prepared:

| Ingredients | Parts by Weight |
|---|---|
| Ethyl butyrate | .05 |
| Ethyl valerate | .05 |
| Maltol | 2.00 |
| Cocoa extract | 26.00 |
| Coffee extract | 10.00 |
| Ethyl alcohol | 20.00 |
| Water | 41.90 |

The above-stated tobacco flavor formulation is applied at the rate of 0.1% to all of the cigarettes produced using the above tobacco formulation. Half of the cigarettes are then treated with 500 or 1,000 ppm of beta-cyclohomocitral produced according to the process of Example XIII. The control cigarettes not containing the beta-cyclohomocitral produced according to the process of Example XII and the experimental cigarettes which contain the beta-cyclohomocitral produced according to the process of Example XIII are evaluated by paired comparison and the results are as follows:

The experimental cigarettes are found to have more body and to be, on smoking, sweeter, richer, more tobacco-like and less harsh with woody, damascenone-like notes.

The tobacco of the experimental cigarettes, prior to smoking, has sweet, floral, fruity, earthy and green notes. All cigarettes are evaluated for smole flavor with a 20 mm cellulose acetate filter.

The beta-cyclohomocitral produced according to the process of Example XIII enhances the tobacco-like taste and aroma of the blended cigarette imparting to it woody, "damascenone-like" notes.

EXAMPLE XV

Perpropionic acid is prepared in the following manner. A mixture of the following materials:

| | |
|---|---|
| 160 ml propionic acid<br>1 ml sulfuric acid (concentrated)<br>40 g 50% hydrogen peroxide | Referred to hereinafter as "Mixture A" |

is allowed to stand for 20 hours at room temperature.

The following reactants are placed in a 500 ml reaction flask equipped with a stirrer and cooling bath:

| | |
|---|---|
| 140 ml propionic acid<br>75 g potassium acetate<br>60 g beta-ionone | Referred to hereinafter as "Mixture B" |

To the stirred Mixture B is added, dropwise, Mixture A over a 60-minute period while maintaining the reaction temperature at 25° C ± 2° C by means of external cooling. When the addition is complete the reaction mixture is stirred for an additional 2 hours at 25° C.

The reaction mixture is then poured into 1,000 ml water and extracted twice with 250 ml portions of diethyl ether. The combined ether extracts are then washed first with water (three 100 ml portions) and then with a saturated solution of sodium chloride (150 ml). The ether solution is then dried over anhydrous magnesium sulfate and the solvent evaporated to yield 78 g of crude oil containing propionic acid as well as product. The crude product is hydrolyzed with a solution of 40 g potassium carbonate in 300 ml of water by heating under reflux, with stirring, for 15 hours. After cooling the organic layer is collected and the aqueous layer is extracted with 200 ml of diethyl ether. After combining the organic materials the solvent is removed by evaporation to yield 57.5 g of oil which is distilled to yield 19.5 g of beta-homocyclocitral (Yield: 37%).

EXAMPLE XVI

Performic acid is prepared in the following manner: 20 g 50% hydrogen peroxide and 80 ml of formic acid is admixed and the reaction mass is left at room temperature for 1.5 hours.

To a mixture consisting of 50 g of potassium acetate, 70 ml of acetic acid and 30 g of beta-ionone is added the preformed performic acid, prepared as described above, dropwise over a 30 minute period while maintaining the temperature of the stirred reaction mass at 25° C by means of external cooling. After the addition is complete, the mixture is stirred for a further 90 minutes at 25° C and is then poured into 800 ml of water. The product is extracted with two 200 ml portions of diethyl ether. The ether extracts are combined, washed with two 150 ml portions of saturated sodium chloride solution and then dried. Removal of the solvent by evaporation yields 32.5 g crude oil.

A gas chromatographic analysis of this material shows the following compositions:

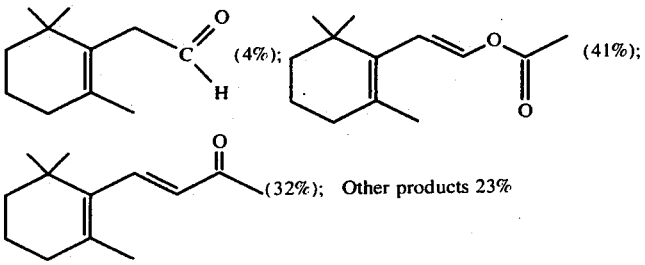

The following mixture is prepared:
20 g Lithium carbonate
200 ml 50% aqueous methanol To this is added the crude enol ester product obtained as described above. The mixture is then heated at 65°–70° C until substantially complete hydrolysis of the enol ester to beta-homocyclocitral as indicated by gas chromatographic analysis. Water is added to the reaction mass which is then extracted with three 100 cc portions of diethyl ether. The combined ether extracts are washed twice with two 100 cc portions of saturated sodium chloride solution, dried over anhydrous magnesium sulfate and evaporated to obtain an oil, betacyclohomocitral.

The crude is distilled at 2 mm Hg pressure and the fraction boiling at 70°–80° C is collected.

Gas chromatographic analysis indicates that the product is about 85% pure. A pure sample of betacyclohomocitral is obtained by preparative chromatography and is characterized by the following analytical data as:

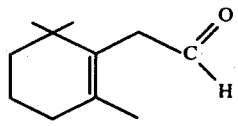

Mass spectral fragmentation, in decreasing order of ion abundance:

m/e (%) 107(100); 29(93); 151(90); 41(88); 81(80); 95(67); 123(57); 55(45); 39(45); 27(43); 166 (Mol ion) (35).

Infrared spectrum shows characteristic absorption at:

| | |
|---|---|
| 2760 $cm^{-1}$ | O<br>‖<br>C—H |
| 1770 $cm^{-1}$ | C=O (unconjugated) |
| 1380, 1360 $cm^{-1}$ | $CH_3$ $CH_3$<br>\ /<br>C |
| 1375 $cm^{-1}$ | $-CH_3$ |

The NMR Spectrum of the compound is in agreement with the above structure:

| (PPM) | Multiplicity | Assignment | Number of Protons |
|---|---|---|---|
| 0.98 | (s) | $CH_3$<br>\<br>C<br>/<br>$CH_3$ | 6H |

-continued

| (PPM) | Multiplicity | Assignment | Number of Protons |
|---|---|---|---|
| 1.58 | (s) | | 9H |
| 1.80–1.42 | (m) | $=C-CH_3$ / $-CH_2-$ | |
| 2.00 | (t) | $=C-CH_2-\overset{O}{\overset{\|\|}{C}}$ | 2H |
| 9.58 | (t) | HC=O | 1H |

EXAMPLE XVII

TOBACCO FORMULATION

A tobacco mixture is produced by admixing the following ingredients:

| Ingredients | Parts by Weight |
|---|---|
| Bright | 40.1 |
| Burley | 24.9 |
| Maryland | 1.1 |
| Turkish | 11.6 |
| Stem (flue-cured) | 14.2 |
| Glycerine | 2.8 |
| Water | 5.3 |

Cigarettes are prepared from this tobacco.

The following flavor formulation is prepared:

| Ingredients | Parts by Weight |
|---|---|
| Ethyl butyrate | .05 |
| Ethyl valerate | .05 |
| Maltol | 2.00 |
| Cocoa extract | 26.00 |
| Coffee extract | 10.00 |
| Ethyl alcohol | 20.00 |
| Water | 41.90 |

The above-stated tobacco flavor formulation is applied at the rate of 0.1% to all of the cigarettes produced using the above tobacco formulation. Half of the cigarettes are then treated with 500 or 1,000 ppm of beta-cyclohomocitral produced according to any one of the processes described in Examples I - VIII (inclusive), X, XI, XV or XVI. The control cigarettes not containing this beta-cyclohomocitral and the experimental cigarettes which contain the beta-cyclohomocitral produced according to any one of the processes of Example I-VIII (inclusive), X, XI, XV or XVI are evaluated by paired comparison and the results are as follows:

The experimental cigarettes are found to have more body and to be, on smoking, sweeter, richer, more tobacco-like and less harsh with woody, damascenone-like notes.

The tobacco of the experimental cigarettes, prior to smoking, has sweet, floral, fruity, earthy and green notes. All cigarettes are evaluated for smoke flavor with a 20 mm cellulose acetate filter.

The beta-cyclohomocitral produced according to any one of the processes of Example I-VIII (inclusive), X, XI, XV or XVI enhances the tobacco-like taste and aroma of the blended cigarette imparting to it woody, damascenone-like notes.

What is claimed is:

1. A process for altering, modifying or enhancing the aroma or taste properties of a consumable material selected from the group consisting of smoking tobacco and smoking tobacco substitutes which comprises adding thereto from 250 ppm up to 1,500 ppm, based on the weight of smoking tobacco material, of a composition comprising 2,6,6-trimethyl-1-cyclohexen-1-ylacetaldehyde having the structure:

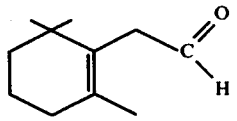

2. The proces according to claim 1, wherein the consumable material is a tobacco.

3. A smoking tobacco flavoring composition comprisjng from 0.25 up to 1.5% of 2,6,6-trimethyl-1cyclohexen-1-ylacetaldehyde having the structure:

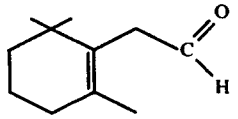

and the remainder of the composition a flavor adjuvant compound selected from the group consisting of ethyl butyrate, ethyl valerate and maltol.

* * * * *

UNITED STATES PATENT OFFICE

CERTIFICATE OF CORRECTION

Patent No. 4,014,351 Dated March 29, 1977

Inventor(s) Alan Owen Pittet et al.

It is certified that error appears in the above-identified patent and that said Letters Patent are hereby corrected as shown below:

Column 2, line 22, "apha" should read -- alpha --.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*